United States Patent [19]

Kruger

[11] Patent Number: 4,520,799

[45] Date of Patent: Jun. 4, 1985

[54] FACIAL TREATMENT DEVICE

[76] Inventor: Sandra J. Kruger, 2901 Avenida Caballeros, Palm Springs, Calif. 92262

[21] Appl. No.: 648,610

[22] Filed: Sep. 7, 1984

Related U.S. Application Data

[63] Continuation of Ser. No. 580,753, Feb. 17, 1984, abandoned, which is a continuation of Ser. No. 415,750, Sep. 7, 1982, abandoned.

[51] Int. Cl.[3] ..... A61H 7/00

[52] U.S. Cl. ..... 128/67; 128/62 R; 132/DIG. 3

[58] Field of Search ..... 128/61, 62 R, 65, 67, 128/24.1, 76 B, 355; 604/309, 313, 291, 290; D28/7; D24/23, 36, 41, 63; 132/79, DIG. 3

[56] References Cited

U.S. PATENT DOCUMENTS

D. 113,159 1/1939 De Filippis ..... D24/36

1,965,861 7/1934 Schneider ..... 128/62 R

*Primary Examiner*—Stephen C. Pellegrino

*Assistant Examiner*—Sherri E. Vinyard

*Attorney, Agent, or Firm*—William P. Green

[57] ABSTRACT

A facial treatment device having a handle and having a head formed of highly heat conductive material such as stainless steel or aluminum, with the head having two opposite side surfaces one of which is curved convexly and the other of which is curved concavely, and having a rounded peripheral edge surface shaped to form a curved recess at a predetermined location along the edge of the device.

7 Claims, 3 Drawing Figures

FIC 3

FACIAL TREATMENT DEVICE

This application is a continuation of application Ser. No. 580,753, filed Feb. 17, 1984, which was a continuation of application Ser. No. 415,750, filed Sept. 7, 1982, both now abandoned.

BACKGROUND OF THE INVENTION

This invention relates to improved facial treatment devices for assisting in smoothing and beautifying a user's skin.

Various types of devices have been proposed in the past for massaging or otherwise acting on the facial tissues in an effort to remove or reduce wrinkles and thereby improve the appearance and tone of the face. For example, U.S. Pat. No. 1,815,560 shows a massage instrument having a soft rubber element carried by a metal backing plate and adapted to rub, stroke or knead the face at critical areas. U.S. Pat. Nos. 1,399,340 and 923,158 show other face massaging devices.

SUMMARY OF THE INVENTION

A major purpose of the present invention is to provide an improved facial treatment device which can be utilized to apply moisture and/or cosmetic creams or the like to various facial areas, and which is capable of gently rubbing the skin in a manner removing dead cells therefrom and assisting in smoothing over wrinkled or irregularized areas to produce a vastly improved overall appearance. The device is formed of a highly heat conductive material, such as stainless steel or aluminum, which can be either heated or chilled prior to contact with the face, and can thus either heat or cool the contacted areas during treatment. The contours of the various surfaces of the device are specially designed to fit and act against the facial contours of a person in optimum fashion, in order to apply the moisture and/or cosmetic creams and attain the desired smoothing effect at all of the various critical areas of the face.

In order to achieve these results, a device embodying the invention includes a handle by which it can be held and manipulated by a user, and a head carried at an end of the handle and having a predetermined configuration. The head has two opposite side surfaces one of which is concavely curved and faces in a predetermined direction along an axis of the device, and the other of which is convexly curved and faces in the opposite axial direction. A peripheral edge surface of the head extends along the periphery of and borders the opposite side surfaces, and is smoothly rounded as viewed in planes containing the mentioned axis. The peripheral edge, as viewed in a plane disposed transversely of that axis, is shaped at a predetermined location to form a recessed area curved concavely inwardly toward the axis in that plane, with other portions of the peripheral edge surface being curved convexly as viewed in the transverse plane. The recessed area is found to be extremely important in reaching the areas under and around a user's eyes, and around the nose and other locations of the face, while the convexly and concavely curved opposite side surfaces match and act on chin areas and other portions of the face, and the non-recessed portions of the peripheral edges can fit into and treat still other facial areas. Thus, the numerous differently contoured surfaces provided by this specifically discussed configuration adapt the device for effective use on virtually all facial areas.

The heat conductive characteristics of the head of the device enable it to be easily heated or cooled by merely running hot water or cold water over it from a hot or cold water tap, with the moisture which remains on the device after such heating or cooling having the effect of moisturizing the skin and any cosmetic cream thereon when the device is then placed against the skin.

BRIEF DESCRIPTION OF THE DRAWING

The above and other features and objects of the invention will be better understood from the following detailed description of the typical embodiment illustrated in the accompanying drawing, in which:

FIG. 3 is an enlarged fragmentary vertical section taken on line 3—3 of FIG. 1.

DESCRIPTION OF THE PREFERRED EMBODIMENT

Figure 1:
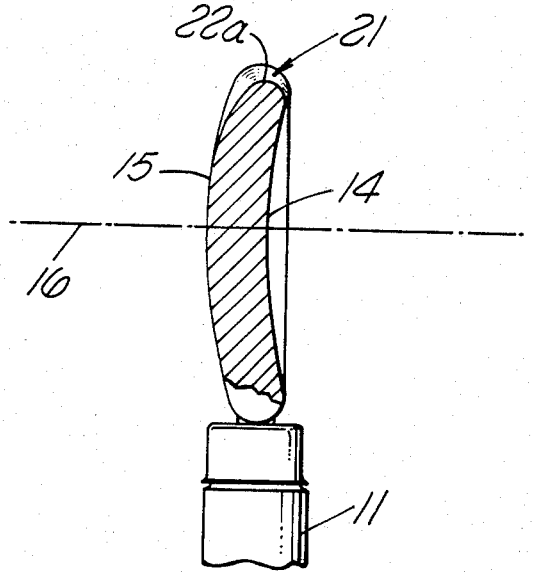
FIG. 1 shows a facial treatment device embodying the invention illustrated partially in elevation and partially in section on line 1—1 of FIG. 2.

The facial treatment device 10 illustrated in the drawing includes an elongated handle 11 adapted to be held by a user and carrying at its upper end as viewed in FIG. 1 a head 12 for contacting and smoothing facial tissues of a user. The handle may be formed of any appropriate material, such as a suitable resinous plastic material.

Head 12 is formed of a highly heat conductive material, desirably a metal such as stainless steel or aluminum machined or otherwise shaped to the illustrated configuration. The head may consist of a single piece of such material, having a connecting tang 13 projecting downwardly therefrom and embedded within and bonded to the material of handle 11 to form a rigid connection between the handle and head.

Figure 2:
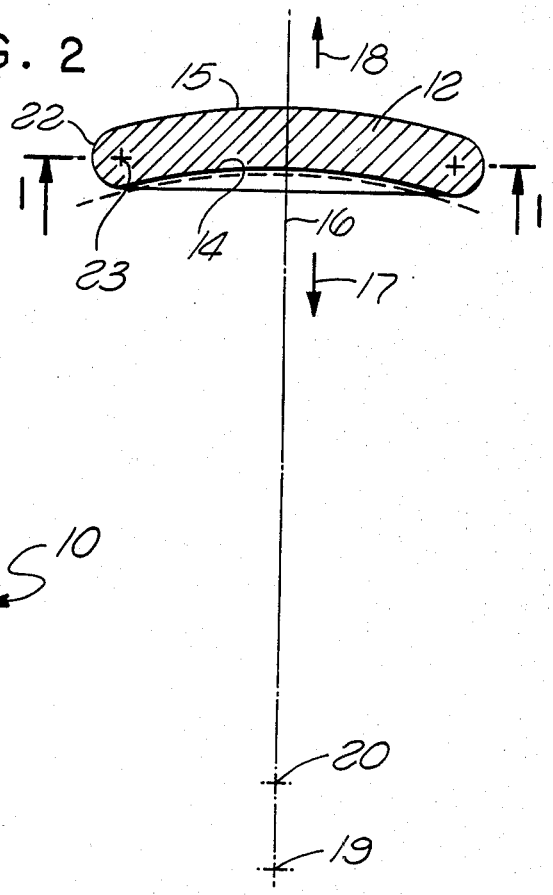
FIG. 2 is an enlarged transverse section taken on line 2—2 of FIG. 1.
Figure 2:
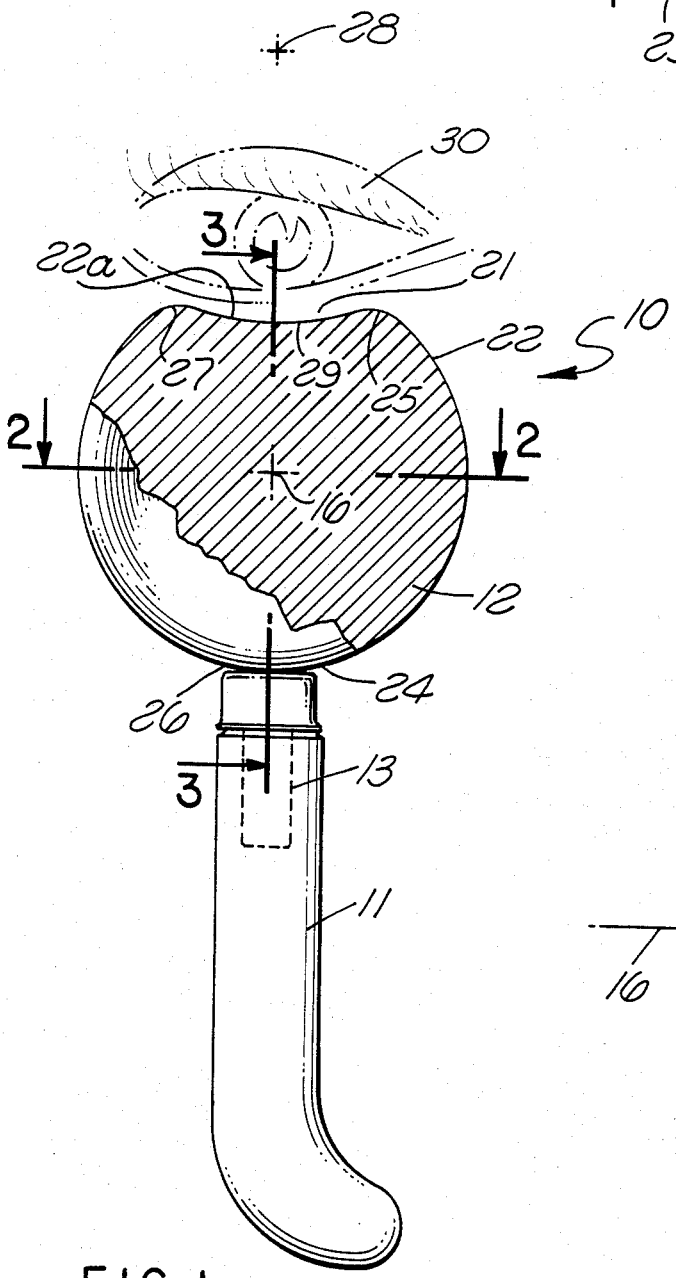

As seen in FIGS. 2 and 3, head 12 has two surfaces 14 and 15 at its opposite sides which extend generally parallel to one another, with the first of these faces 14 being curved concavely, and the second face 15 being curved convexly. These surfaces in their optimum configuration can best be defined by reference to a central axis 16 of head 12. Surface 14 faces in a first direction 17 along axis 16, while surface 15 faces in the opposite direction 18 along that same axis. Surface 14 may be curved spherically about a center 19 located on axis 16, and the oppositely facing surface 15 may be curved spherically about a second center 20 located on axis 16 and spaced from center 19. Surfaces 14 and 15 may have this spherical curvature over their entire area, except at the location of a recess 21 formed in the upper portion of head 12 as viewed in FIG. 1.

The outline configuration of head 12 may be circular about axis 16 along the entire periphery of the head except at the location of recess 21. This circular configuration of head 12 is defined by a peripheral edge surface 22 of the head which extends continuously about its entire circular extent except at the location of attachment of handle 11. Head surface 22 is rounded as seen in FIGS. 2 and 3 so that all surfaces of the head which can be moved into contact with a facial area are smooth and can contact the skin without damage thereto.

To describe more specifically the sectional configuration of peripheral edge surface 22 in the plane represented in FIG. 2, which plane contains central axis 16 of the device, it is noted that surface 22 as viewed in that plane may be curved essentially arcuately about a center or axis 23, at a radius enabling surface 22 to merge with and form in effect a continuation of surface 14 at one side of the head, and surface 15 at the opposite side of the head. This cross-sectional configuration of peripheral edge surface 22 may be the same at all locations between the point 24 adjacent the handle in FIG. 1 and the location 25 at one end of recess 21. Similarly, at the other side of the handle, the cross-sectional configuration of peripheral edge surface 22 as viewed in FIG. 2 can be the same from the location 26 to the second end 27 of recess 21. Along these entire regions between the locations 24 and 25, and the locations 26 and 27, the sectional configuration of the head as viewed in planes containing axis 16 is essentially the same as illustrated in FIG. 2.

The preferred configuration of the head 12 may be further defined by reference to its cross-sectional shape as viewed in FIG. 1, which may be considered as taken in the plane 1—1 of FIG. 2 disposed perpendicular to the previously mentioned central front to rear axis of the head. As seen in this plane, the peripheral edge surface 22 curves convexly and preferably circularly about axis 16 between the locations 24 and 25 of FIG. 1, and between the locations 26 and 27 of that figure, thus giving the head an overall essentially circular peripheral outline configuration. At the location of recess 21 between locations 25 and 27 of FIG. 1, peripheral edge surface 22 of the head is curved concavely as viewed in the plane 1—1 of FIG. 2 perpendicular to axis 16. This recessed portion **22*a* of peripheral edge surface 22 may extend arcuately about an axis 28 disposed parallel to axis 16 and perpendicular to the plane 1—1. At the junctures 25 and 27 of the portions of surfaces 22 having the configuration illustrated in FIG. 2 and the recessed portion 22*a* of the peripheral edge surface, these different surface areas may merge together in smoothly rounded regions. It is also noted, as seen in FIG. 3, that at the central portion of the recessed region 22*a*, peripheral edge 22*a* of the head may be somewhat thinner in a direction parallel to axis 16 than are the portions of the peripheral surface 22 between locations 24 and 25 and locations 26 and 27. As the peripheral edge extends laterally in FIG. 1 from the central location 29, the thickness of the upper edge of head 12 may gradually increase from the condition illustrated in FIG. 3 to the locations 25 and 27 at which the axial thickness corresponds to that represented in FIG. 2**.

In using the device illustrated in FIGS. 1 to 3, a person may first apply a cosmetic cream such as deep pore cleansing cream, moisture cream concentrate, or rejuvenating night cream, to the face, and then heat and moisten the head 12 of the device 10 by placing the head under hot running tap water until it reaches a temperature as high as the facial tissues can comfortably withstand. The user while holding the handle of the device then moves its head 12 into engagement with an area of the face, and moves it in a circular motion over the surface of the face while in light contact therewith in a manner tending to smooth the facial tissues, remove dead cells therefrom, and add moisture to the cream and face by carrying some of the tap water on the surface of the head of the device 10 to the facial tissues. The device is repeatedly placed under the running hot tap water as often as necessary to keep it comfortably hot and moist as all areas of the face are treated in the discussed manner. The various different contours of the external surfaces of head 12 of the device 10 afford shapes which can properly contact and smooth over all of the different facial contours which may be encountered. For example, the upper recessed area 21 of head 12 as viewed in FIG. 1 can be moved to a position at the underside of the user's eye (represented at 30 in FIG. 1), and then can be moved laterally along the entire under eye area to assist in removing wrinkles at that location. This same recessed area **22*a* can fit about and smooth over areas around the nose, mouth, and other facial regions. The doubly convexly curved portions of the peripheral edge 22 between locations 24 and 25, and between locations 26 and 27, effectively contact and treat other differently contoured areas of the face. The concave surface 14 fits the cheek areas, chin, etc. and the convex surface 15 at the opposite side of head 12** can engage beneath the chin and along the neck. At all of these locations, the tendency of the device is similar to that of pressing or smoothing the wrinkles from a fine delicate fabric. The stimulating and exhilarating moist-heat from the device gently soothes, smooths and refreshes the face, and revivifies the complexion tone.

After the entire face has been treated with the heated and moistened device as discussed, the pores of the face may be closed by holding the highly heat conductive head 12 beneath a cold water tap or in contact with ice, to lower its temperature, after which the cooled and still moist head can be moved into engagement with all of the previously contacted surfaces to close the pores. If desired, the high temperature and low temperature effects may be repeated alternately several times to optimize the result.

While a certain specific embodiment of the present invention has been disclosed as typical, the invention is of course not limited to this particular form, but rather is applicable broadly to all such variations as fall with the scope of the appended claims.

I claim:

1. A facial treatment device comprising:

a handle; and a head carried by said handle for contacting a person's skin and which is formed of highly heat conductive material;

said head having two opposite side surfaces, one of which is concavely curved and faces in essentially a first direction along a predetermined axis and the other of which is convexly curved and faces in generally the opposite direction along essentially said axis;

the periphery of said head, as viewed in a plane disposed transversely of said axis, being defined by an outer edge surface of the head extending essentially about said axis and facing generally away from the axis;

said handle being elongated and connected at a first end thereof to said periphery of the head, at a first side of said axis, and projecting essentially away from said axis;

said periphery of the head, as viewed in said plane disposed transversely of said axis, containing a recess which curves smoothly inwardly toward said axis at a location essentially diametrically opposite the location of said handle;

said periphery of the head having two additional portions at opposite sides of said axis which extend between said recess and opposite sides of said handle, and which are curved convexly as viewed in said transverse plane;

said outer edge surface of the head, as viewed in planes containing said axis, being rounded convexly and smoothly in a relation emerging with and joining said opposite side surfaces along essentially the entire periphery of said head except at the location of said handle, and including the portion of the periphery containing said recess and said two additional portions extending between the recess and handle.

2. A facial treatment device as recited in claim 1, in which said head as viewed in said plane disposed transversely of said axis is essentially circular except at the location of said recess.

3. A facial treatment device as recited in claim 1, in which said opposite side surfaces of said head are curved essentially spherically about centers located on said axis and are essentially parallel to one another.

4. A facial treatment device as recited in claim 1, in which said head is thinner at the location of said recess than at other locations along the periphery of the head.

5. A facial treatment device as recited in claim 1, in which said recess is curved essentially arcuately as viewed in said plane disposed transversely of said axis.

6. A facial treatment device as recited in claim 1, in which said opposite side surfaces of said head are essentially parallel to one another and curved essentially spherically about centers located on said axis; said head, as viewed in said plane disposed transversely of said axis, being essentially circular except at the location of said recess; said recess being curved essentially arcuately as viewed in said transverse plane; and said head being thinner at said recess than at other locations along the periphery of the head.

7. A facial treatment device comprising:

a handle; and a head carried by said handle for contacting a person's skin and which is formed of a highly heat conductive metal;

said head having two similarly curved opposite side surfaces generally parallel to one another, one of which faces in a first direction along a predetermined first axis and is curved substantially spherically and concavely about a first center located essentially on said axis;

the other of said side surfaces facing in the opposite direction along said axis and being curved substantially spherically and convexly about a second center located essentially on said axis and spaced from said first center;

said head, as viewed in a plane disposed transversely of said axis, having an outer edge surface extending essentially about said axis and facing generally away from the axis;

said handle being elongated and connected at a first end thereof to the periphery of said head, at a first side of said first axis, and projecting away from said first axis;

said outer edge surface of the head, as viewed in said plane disposed transversely of said first axis, having a portion defining a recess which curves smoothly inwardly toward said first axis at a location essentially diametrically opposite the location of said handle with respect to said first axis and which extends essentially arcuately about a second axis offset from said first axis;

said outer edge surface of the head having two additional portions at opposite sides of said first axis which extend between said recess and opposite sides of said handle, and which are curved convexly and essentially arcuately about said first axis as viewed in said transverse plane;

said head as viewed in said transverse plane being substantially circular about said first axis except at the location of said handle and said recess;

said outer edge surface of the head, as viewed in planes containing said first axis, being rounded convexly and smoothly in a relation merging with and joining said opposite side surfaces along essentially the entire periphery of said head except at the location of said handle, and including the portion of said outer edge surface defining said recess and said two additional portions extending between the recess and handle;

the periphery of said head being thinner at the location of said recess than at said additional portions of said outer edge surface extending between said recess and said handle.

* * * * *